US010449759B2

(12) United States Patent
Trachanas et al.

(10) Patent No.: US 10,449,759 B2
(45) Date of Patent: Oct. 22, 2019

(54) COMPENSATION METHOD FOR FAILED PRINTING NOZZLES

(71) Applicant: HEIDELBERGER DRUCKMASCHINEN AG, Heidelberg (DE)

(72) Inventors: Ilias Trachanas, Plankstadt (DE); Martin Mayer, Ladenburg (DE); Peter Hachmann, Weinheim-Hohensachsen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 16/110,126

(22) Filed: Aug. 23, 2018

(65) Prior Publication Data

US 2019/0070848 A1 Mar. 7, 2019

(30) Foreign Application Priority Data

Sep. 5, 2017 (DE) ..... 10 20147 215 590

(51) Int. Cl.
*B41J 2/045* (2006.01)
*B41J 2/21* (2006.01)
*B41J 25/00* (2006.01)

(52) U.S. Cl.
CPC ..... *B41J 2/0451* (2013.01); *B41J 2/04586* (2013.01); *B41J 2/04593* (2013.01); (Continued)

(58) Field of Classification Search
CPC .. B41J 2/0451; B41J 2/04586; B41J 2/04593; B41J 2/2139; B41J 2/2146; B41J 2025/008
See application file for complete search history.

(56) References Cited

U.S. PATENT DOCUMENTS 6,219,153 B1 4/2001 Kawanabe et al.
6,637,853 B1 10/2003 Ahne et al.
(Continued)

FOREIGN PATENT DOCUMENTS

DE 69833419 T2 8/2006
DE 60220361 T2 1/2008
(Continued)

*Primary Examiner* — Thinh H Nguyen
(74) *Attorney, Agent, or Firm* — Laurence A. Greenberg; Werner H. Stemer; Ralph E. Locher

(57) ABSTRACT

A method corrects for defective printing nozzles in an ink jet printing machine via a computer. The defective printing nozzles are compensated for after the screening process by neighboring printing nozzles applying an increased amount of ink. The method includes precalculating different compensation halftones for different area coverages by the computer, printing the compensation halftones embedded in area coverage halftone areas, evaluating the printed compensation halftones via the computer, and selecting and saving, for every area coverage level, the compensation halftone that best matches the coloration of the original halftone in the respective area coverage halftone area. A defective printing nozzle is detected during production printing by the computer. The local area coverage is determined along the detected defective printing nozzle by the computer. The compensation halftone that has been saved for the determined local area coverage is used to compensate for the defective printing nozzles via the computer.

10 Claims, 4 Drawing Sheets

(52) U.S. Cl.
CPC ..... *B41J 2/2139* (2013.01); *B41J 2/2146* (2013.01); *B41J 2025/008* (2013.01)

(56) References Cited

U.S. PATENT DOCUMENTS

| | | | | |
|---|---|---|---|---|
| 6,863,361 | B2 * | 3/2005 | Barr | B41J 2/0451 347/19 |
| 9,375,964 | B2 | 6/2016 | Koehler et al. | |
| 2005/0030327 | A1 | 2/2005 | Tatsumi | |
| 2006/0061616 | A1 | 3/2006 | Yamazaki | |
| 2007/0070111 | A1 | 3/2007 | Vladislav | |
| 2010/0165022 | A1 | 7/2010 | Makuta et al. | |
| 2011/0084996 | A1 | 4/2011 | Hirai et al. | |

FOREIGN PATENT DOCUMENTS

| | | | |
|---|---|---|---|
| DE | 102015220716 | A1 | 5/2016 |
| EP | 2952355 | A1 | 12/2015 |

* cited by examiner

COMPENSATION METHOD FOR FAILED PRINTING NOZZLES

CROSS-REFERENCE TO RELATED APPLICATION

This application claims the priority, under 35 U.S.C. § 119, of German application DE 10 2017 215 590.6, filed Sep. 5, 2017; the prior application is herewith incorporated by reference in its entirety.

BACKGROUND OF THE INVENTION

Field of the Invention

The present invention relates to a method for correcting defective printing nozzles in an ink jet printing machine by use of a compensation halftone.

The technical field of the invention is the field of digital printing.

In digital printing or, to be more precise, in ink jet printing and especially in industrial large-format printing, printing nozzles that do not work properly or have failed completely have a very detrimental effect on print quality and therefore present a serious problem. Such defective printing nozzles, also referred to as "missing nozzles", have various causes and occur in many different manifestations. Dried-on ink residues from previous print jobs that block the printing are one of the most frequent causes. Other causes of a technical nature are ink feed problems at the individual nozzle or electronic actuation problems at an individual nozzle.

The effects such a missing nozzle may have on the print image are likewise manifold. For instance, the affected printing nozzle may only print a reduced volume of ink, resulting in distorted color values at the location of the affected nozzle in the printed image. A partial blocking of a printing nozzle may cause the printing nozzle to print at an angle, resulting in a dot offset, which also has negative effects on the printed image. If a printing nozzle has completely failed, white lines are created in the printed image. This means that in a monochrome area, the printing material is visible at the location of the missing printing nozzle and in a multicolor image, the color that would be applied by the defective printing nozzle is missing. Both these phenomena lead to strip-like artifacts in the printed image.

If a missing nozzle prints at an angle, a white line is created at the location where the defective printing nozzle ought to print and a dark line is created at the location where the printing nozzle in question actually prints and where consequently too much ink is applied.

There have been various approaches to counteract the white line problem in particular. One approach is to modify the color values of a printed image in such a way that the white line that has been created by a detected missing nozzle is compensated for. In this process, the color values next to the white line in the printed image are increased, for instance, to counteract the loss of color in the white line to the human eye. One example of this approach is the method disclosed in U.S. Pat. No. 9,010,898 B2. A disadvantage of this method is, however, that the approach is implemented before the screening process. This means that once a missing nozzle has been detected and the color values of the print have been adapted, the print image needs to be screened again. Since missing nozzles are in general detected in the course of a printing operation, the print image needs to be screened again every time during the printing operation. This has an adverse effect on the productivity of the printing machine.

Other approaches are to increase the amount of ink applied by the nozzles next to the missing nozzle. In an ideal case, they apply enough ink for it to run into the white line and make it invisible due to the increased amount of ink from the neighboring printing nozzles. An example of this is the method disclosed in U.S. patent publication No. 2016/144613 A1. However, a disadvantages of this approach to a solution is that for sufficient ink to run into the white line, a very high amount of ink needs to be applied, frequently resulting in overcompensation, which in turn creates a dark line. Another disadvantage of this approach is that the compensation changes the halftone due to the increased amount of ink that is applied by the neighboring printing nozzles. The halftone is created in accordance with specific rules. If these rules are ignored, visible defects, namely artifacts, may be created in the halftone of the print image. If the amount of ink applied by neighboring printing nozzles is increased after the screening process has taken place, these rules can obviously not be observed and artifacts will be the result.

There are many more approaches to compensating for failed printing nozzles; even combinations of the individual approaches are known. For instance, published European patent application No. EP 2952355 A1 discloses a method for compensating for failed printing nozzles wherein a failed printing nozzle is detected and then the environment density in the area surrounding the white line in the print is determined. Then the environment density is compared with predetermined thresholds, and, based on the deviation of the environment density from the defined thresholds, a decision is made whether the missing nozzle is to be compensated for by modifying the color values in the print and subsequently rescreening the image or by adapting the ink amount of the neighboring printing nozzles after the screening process. An advantage of this approach is that for every specific individual case, the most suitable compensation approach is selected; yet a disadvantage is that the known disadvantages of both compensation approaches remain.

To overcome the disadvantages, it is known in the art to combine both approaches in a different way. One option is, for instance, to calculate correction halftones in advance during the screening process and, when a printing nozzle fails and a white line occurs, too use these precalculated correction halftones at the location of the white line in the print. In general, these correction halftones are precalculated in such a way that an increased amount of ink in the form of an increased ink drop volume is defined at places in the halftone that correspond to the neighboring printing nozzles. To avoid the aforementioned overcompensation, a reduced amount of ink in the form of a reduced ink drop volume is applied in a halftone region that is farther away from the white line, i.e. printed by more remotely neighboring printing nozzles. In this context, the reduced ink drop volume is small enough to reduce overcompensation but not small enough in turn to create an undesired white line. As the correction halftones are calculated during the screening process, all rules of the screening process may be observed and the occurrence of artifacts may be avoided. However, it has been found in practice that this approach is frequently not sufficient to counteract white lines in a satisfactory way. This is due to the fact that since the halftone remains the same, for many colors and substrates there only remains a very small window of action and sometimes no such window at all for the ink to run into the white line and truly compensate for it on the one hand and for a dark line due to overcompensation to be avoided.

SUMMARY OF THE INVENTION

Thus an object of the present invention is to provide a method for compensating for failed printing nozzles that overcomes the disadvantages of the prior art and ensures at least the same level of compensation.

In accordance with the invention, this object is attained by a method for correcting defective printing nozzles in an ink jet printing machine by use of a computer wherein defective printing nozzles are compensated for after the screening process by neighboring printing nozzles that apply an increased amount of ink. The method includes the steps of pre-calculating different compensation halftones for different area coverages by means of the computer, printing these compensation halftones embedded in area coverage halftone areas, evaluating the printed compensation halftones by means of the computer, and selecting and saving, for every area coverage level, the compensation halftone that best matches the coloration of the original halftone in the respective area coverage halftone area by means of the computer. The method further includes detecting a defective printing nozzle during production printing by means of the computer, determining the local area coverage along the detected defective printing nozzle by means of the computer, and using the compensation halftone that has been saved for the determined local area coverage to compensate for the defective printing nozzles by means of the computer.

The core of the method is that the optimum compensation halftone is used for all area coverages that occur. This is attained by precalculating respective different compensation halftones for these different area coverages and using these different compensation halftones in what are referred to as area coverage halftone areas and printing them. The area coverage halftone areas are nothing but test charts, with one test chart consisting of many different individual areas of different area coverages and including white spots in the respective individual areas of the different area coverages to simulate the white lines of the failed printing nozzles. Then the compensation halftone of comparable size is inserted into these white spots so that all precalculated compensation halftones for this area coverage in one of these white spots of the corresponding area coverage halftone area are present. The precalculated compensation halftones may be different for different area coverages; however, it is conceivable to use always the same precalculated compensation halftones for all different area coverages in the corresponding area coverage halftone areas. Although the specific precalculation for a defined area coverage value increases the computational effort, it reduces the printing effort because numerically fewer precalculated compensation halftones need to be printed for every area coverage value. Once these test charts with the area coverage halftone areas of the different area coverages values have been printed, each one of them is evaluated, namely in such a way that the area coverage halftone areas are scanned by an image sensor and digitally evaluated to find out which precalculated compensation halftone was the best for which area coverage value to close the corresponding white spot. This compensation halftone is then saved on the computer for the respective area coverage value. Now if a missing nozzle is detected during a production print on the ink jet printing machine, the local area coverage along the detected defective printing nozzle is determined and the saved compensation halftone corresponding to the local area coverage and working in the most efficient way for the determined area coverage is used to compensate for the defective printing nozzle, which means that it is inserted into the print at the location of the missing nozzle and white line. Then the printing operation is continued using the screened print image that has been manipulated in this way.

Advantageous and preferred further developments of the present invention will become apparent from the associated dependent claims as well as from the description and the associated drawings.

A preferred further development of the method of the invention in this context is that for the local area coverage along the detected defective printing nozzle, respective averages are determined for specific regions along the detected defective printing nozzle and the compensation halftones that have been saved for these averages are used to compensate for the defective printing nozzle. As the local area coverage along the detected defective printing nozzle or rather along the white line caused by the former in the print always changes along the print image, this white line or rather the immediate environment thereof is divided into specific regions. For these regions, local area coverage averages are calculated and then the compensation halftone that corresponds to the calculated local area coverage average in terms of optimum compensation is used for the respective region. This means that the compensation halftone along the entire white line in the screened print image may vary as a function of the detected local area coverage regions.

A further preferred further development of the method of the invention in this context is that the size of the regions along the detected defective printing nozzle corresponds to the size of the precalculated compensation halftones. In this context it makes sense for the size of the regions to correspond to the respective size of the precalculated compensation halftone to ensure that a respective local area value is available for a respective region. A corresponding correction halftone may then be assigned to the region in question and may immediately be inserted into the region because it has the same size. However, it is likewise conceivable for the size of the regions to correspond to the size of multiple precalculated compensation halftones. In this case, a larger compensation halftone formed by combining the selected compensation halftones needs to be used for the region.

A further preferred further development of the method of the invention in this context is that the compensation halftone is precalculated in such a way that it includes a white line caused by a defective printing nozzle at the center and it inserted into a white line caused by the detected defective printing nozzle in order to compensate for the detected missing printing nozzle. Since the compensation halftone is mainly used to compensate for white lines created by missing nozzles and not for printing nozzles that print too little, it has a white line at the center. An advantage of this approach is that the compensation halftone may thus be inserted directly along the white line in the original halftone; this simplifies the handling of the compensation halftone in terms of saving, using and fitting the compensation halftone into the white line to a considerable extent. In contrast, the known prior art approaches rather tend to use respective compensation halftones for the left and right-hand sides along the white line in the halftone. This means, however, that at least two halftones need to be provided for every region along the white line. Since a white line is always present at the location of a missing printing nozzle in the corresponding color separation of the screened print, the compensation halftone to be inserted in a corresponding way may likewise include a white line at the center, allowing it to be more easily inserted into the print image to compensate for the white line caused by the missing nozzle.

A further preferred further development of the method of the invention in this context is that the precalculation of different compensation halftones for different area coverages for ink drop sizes of the compensation halftone is made in a random-based way. If no empirical values or rules based on empirical values are available for the compensation of occurring white lines, a random-based calculation of the correction halftones makes sense. Since the printing machine is capable of producing drops of different sizes, the compensation halftone thus consists of halftone pixels with the different ink drop sizes to the left and right of the white line in addition to the white line at the center. Thus the distribution of the different ink drop sizes in the halftone pixels is made in a random-based way. The total of the compensation halftones to be tested for the corresponding area coverage values results from the number of different ink drop sizes the ink jet printing machine is capable of producing and from the general rules and conditions that apply to the screening process.

A further preferred further development of the method of the invention in this context is that the precalculation of different compensation halftones for different area coverage levels for ink drop sizes of the compensation halftone factors in specific empirical values that are based on previous runs of the method. If empirical values are available that reveal particularly effective halftones for specific area coverage values and indicate less effective halftones, to limit the resultant computational effort, it evidently makes sense to precalculate and subsequently to print especially those compensation halftones that experience has proven to be particularly effective in the area coverage halftone areas and to eliminate less effective compensation halftones when the suitable compensation halftone for a specific area coverage value is determined. Of course, it is likewise possible to combine both approaches and to make random-based calculations within the experience-based rules.

A further preferred further development of the method of the invention in this context is that the rule that the length and width of the precalculated compensation halftone to the left and right of the defective printing nozzle is up to 150 μm is factored in when the compensation halftones are precalculated. The size of the corresponding compensation halftones to the left and right of the white line ought not to exceed a certain maximum size to achieve the best possible compensation for the human eye. A maximum value of 150 μm has been found to be particularly effective. For a resolution of 1,200 dpi, this value corresponds to seven nozzles to the left and seven nozzles to the right of the white line. For a lower resolution, a correspondingly lower number of nozzles is involved. In this context, it should be noted that irrespective of the resolution, at least two nozzles to each side of the white line need to print the compensation halftone because this is the only way to ensure that the increased application of ink to cause the white line to close and the reduced ink application a pixel width away to reduce overcompensation and the formation of a dark line may be implemented.

A further preferred further development of the method of the invention in this context is that the rule that the total ink amount of the selected compensation halftone does not deviate by more than −5% to +30% from the original area coverage halftone that is to be replaced is factored in in the precalculation of the compensation halftone. A deviation of more than 30% of the total ink amount is not advisable because it would inevitably lead to overcompensation. In some situations, it may be necessary to reduce the total ink amount in certain areas. This depends on the print image to be created and the screen that is used. However, the total ink amount ought not to be reduced by more than 5% because it would make white line compensation impossible.

A further preferred further development of the method of the invention in this context is that the rule that the characteristics of the compensation halftone, in particular in terms of frequency, structure size, and preferred direction, correspond to the original area coverage halftone that is to be replaced is factored in when the compensation halftones are precalculated. As indicated above, all these general principles and rules for creating the halftone, i.e. the screened print, also need to be observed when the compensation halftone is created because if not, the aforementioned peculiarities and artifacts may occur. This consequently means that compensation halftones calculated in a random-based way and do not observe these principles and rules, causing the characteristics of the compensation halftone to deviate in a corresponding way, should not be used to compensate for the white line that has occurred. In rare cases this may still happen, for instance if the compensation halftones that observe the principles and rules are incapable of compensating for the white line in a sufficient way. In this case it may be expedient to accept the creation of peculiarities and artifacts because they are less obvious to the human eye than white lines caused by missing nozzles.

A further preferred further development of the method of the invention in this context is that the selected compensation halftones are saved on a driver card for the control unit of the ink jet printing machine, where they are accessed by a control unit of the ink jet printing machine when a defective printing nozzle is detected and used to compensate for the missing printing nozzles. The actual controlling of the compensation process takes place in the control unit of the ink jet printing machine. One component of this control unit is a driver card that is responsible for actuating the individual printing nozzles. The selected compensation halftones are then saved in the memory of this driver card.

The invention as such as well as further developments of the invention that are advantageous in constructional and/or functional terms will be described in more detail below with reference to the associated drawings and based on at least one preferred exemplary embodiment. In the drawings, mutually corresponding elements have the same reference symbols.

Other features which are considered as characteristic for the invention are set forth in the appended claims.

Although the invention is illustrated and described herein as embodied in a compensation method for failed printing nozzles, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
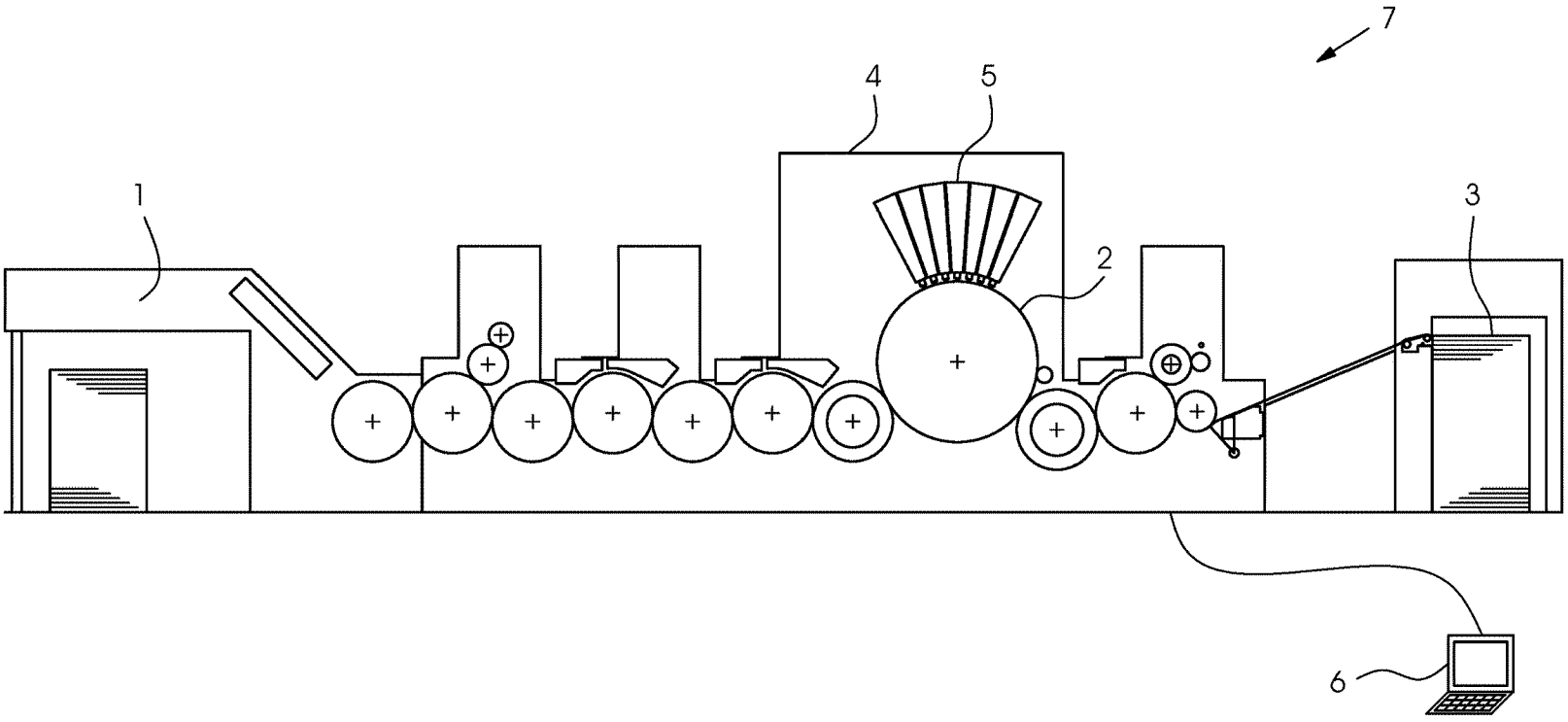
FIG. 1 is an illustration of an example of a digital ink jet printing machine.
Figure 2:
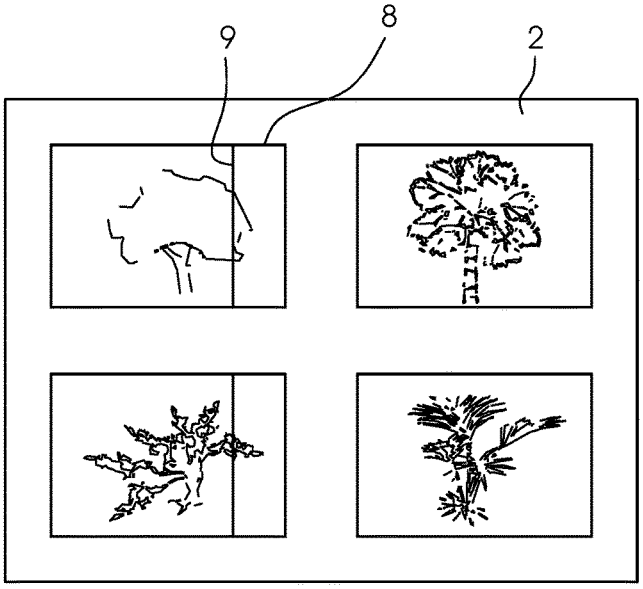
FIG. 2 is an illustration of a schematic example of a white line caused by a missing nozzle.

Referring now to the figures of the drawings in detail and first, particularly to FIG. 1 thereof, there is shown a field of application of a preferred exemplary embodiment being an ink jet printing machine 7. FIG. 1 shows an example of the fundamental design of the printing machine 7, including a feeder 1 for feeding a printing substrate 2 to a printing unit 4, where it receives an image printed by print heads 5, and a delivery 3. The machine is a sheet-fed ink jet printing machine 7, which is controlled by a control unit 6. However, the method of the invention may also be used for other types of digital printing machines 7. While such printing machines 7 are in operation, individual printing nozzles in the print heads 5 in the printing unit 4 may fail as described above. Such a failure results in white lines 9 or, in the case of multicolor printing, in distorted color values. An example of such a white line 9 in a printed image 8 is shown in FIG. 2.

Figure 6:
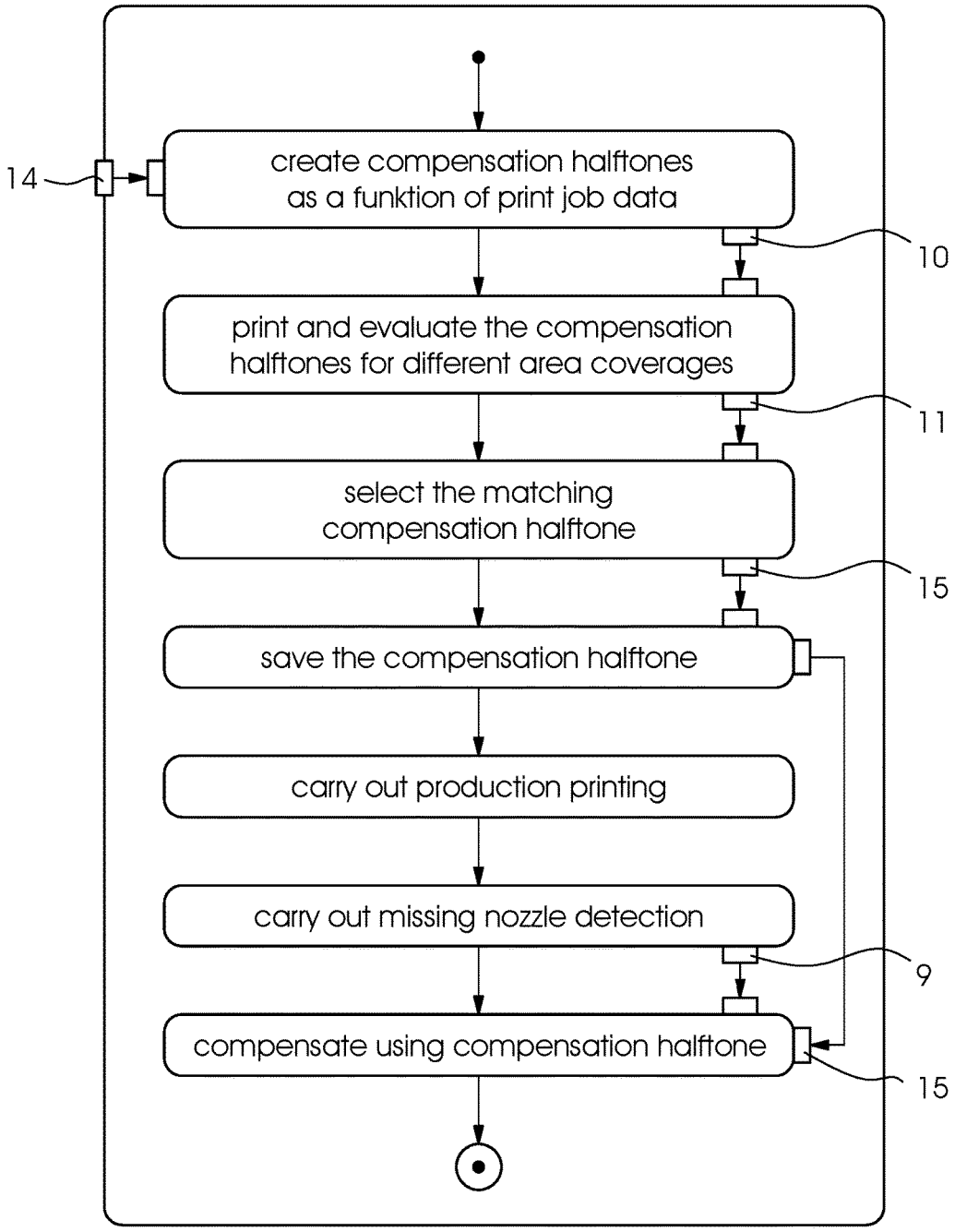
FIG. 6 is a flow chart showing fundamental steps of a method according to the invention.

A preferred embodiment of the method of the invention is schematically shown in FIG. 6. Based on area coverage halftones areas 11 for different area coverage levels or values and as a function of print job data 14, different compensation halftones 10 having a white line 9 at a tile center are configured. The compensation halftones 10 may be developed either in accordance with analytical considerations or in accordance with a random test plan. In general, the compensation halftones 10 vary the area coverage halftone in the region of up to ±150 μm (±7 nozzles for 1200 dpi) about the white line 9. Another specification for selecting suitable compensation halftones 10 is that the total ink amount is to correspond to that of the original area coverage halftone in a region from −5% to +30%. In addition, the characteristics, e.g. in terms of structure size, preferred direction, frequency, etc. of the compensation halftone 10 are approximately to correspond to those of the area coverage halftone.

Figure 3:
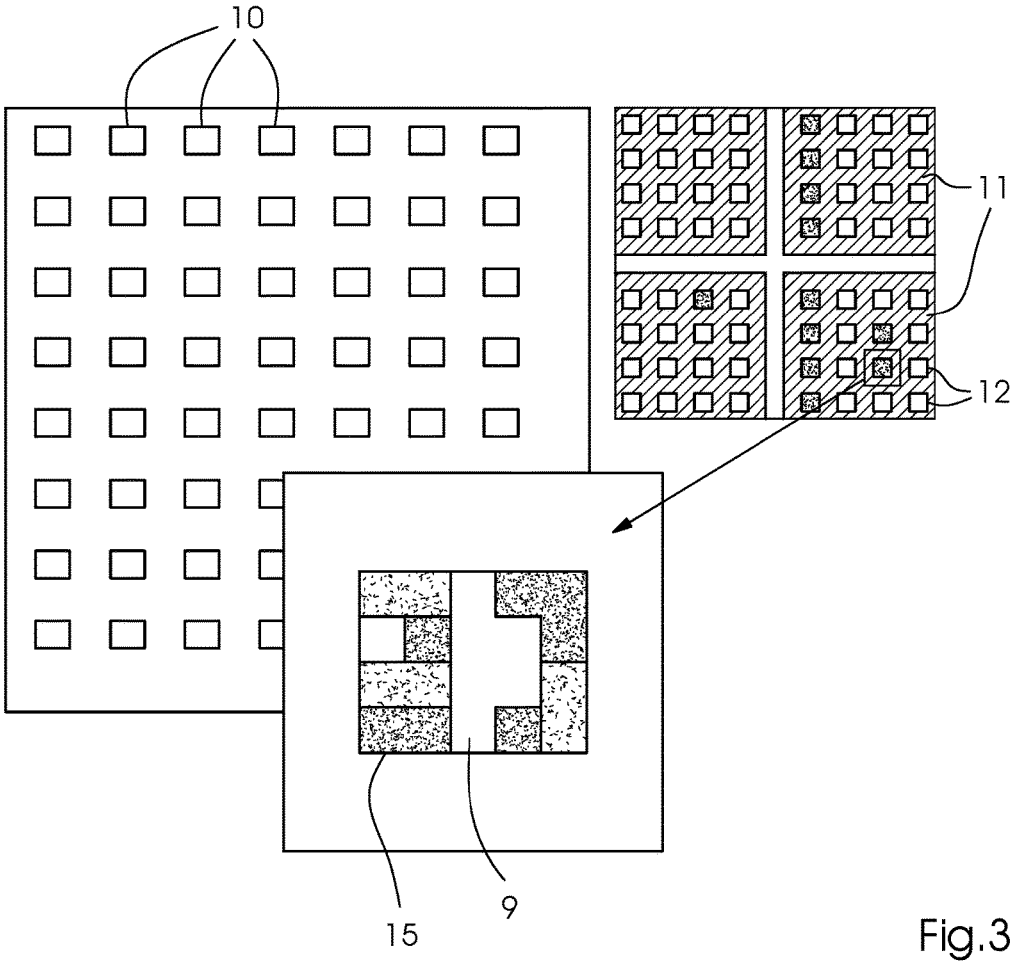
FIG. 3 is an illustration of a process of selecting a suitable compensation halftone based on the area coverage halftone areas.

Then the computer 6 inserts the precalculated compensation halftones 10 into the different area coverage halftone areas 11. They contain a plurality of white areas, referred to as "white spots" 12 in the following text, whose size corresponds to the size of the precalculated compensation halftones 10. Then the precalculated compensation halftones 10 are inserted into these white spots 12. In the area coverage halftone area 11 regions that are outside the white spots 12, a respective area coverage value to be examined is represented. FIG. 3 shows an example of an insertion of the precalculated compensation halftones 10 into the area coverage halftone area 11. FIG. 3 likewise shows how the matching compensation halftone 15 is selected that best covers the white spot 12. The number of area coverage halftone areas 11 that are used depends on the number of area coverage values to be examined. The question whether all precalculated compensation halftones 10 in all area coverage halftone areas 11 are used likewise depends upon the print job. In addition, different precalculated compensation halftones 10 may be tested for different area coverage halftone areas 11, i.e. area coverage values. It is the operator's job to make this decision.

Figure 4:
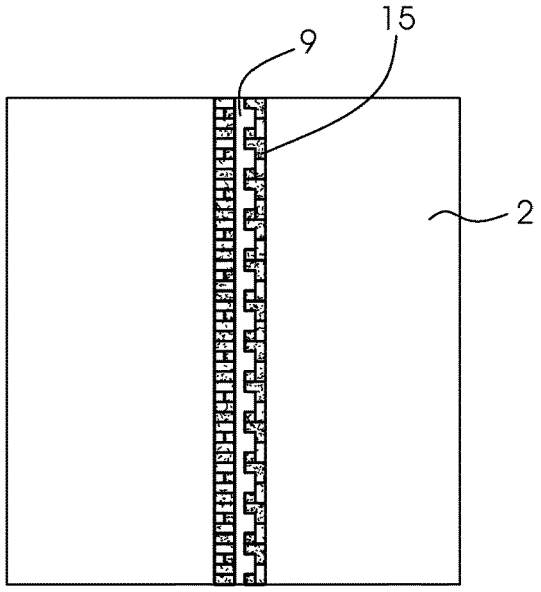
FIG. 4 is an illustration of a white line that has been completely compensated for by selected compensation halftones.
Figure 5:
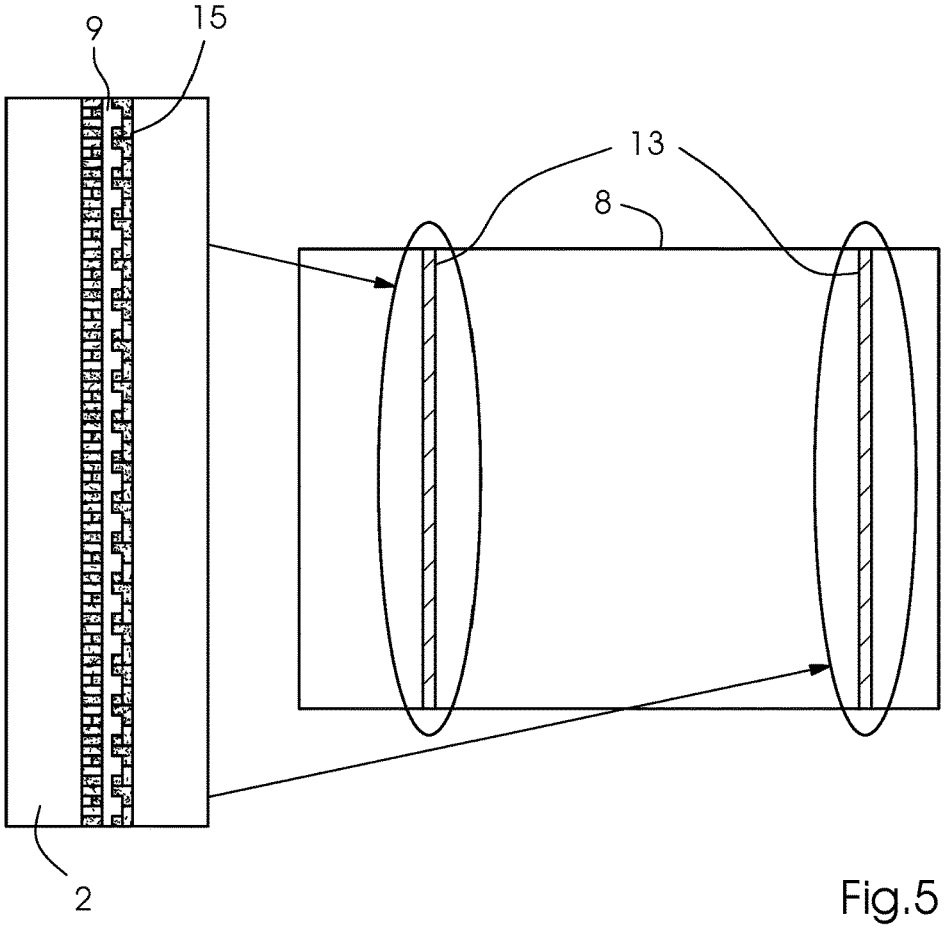
FIG. 5 is an illustration of a use of the entire compensation halftone for compensating for two white lines in the print.

The precalculated compensation halftones 10 are then printed in the white spots 12 of the area coverage halftone areas 11. Then the optical density and the coloration are evaluated for every precalculated compensation halftone 10 in every area coverage halftone area 11. Depending on the results of this evaluation, the compensation halftone 10 that best reproduces the coloration of the original halftone in the respective area coverage halftone area 11 is subsequently selected. The selected compensation halftones 15, together with the corresponding area coverage values thereof, are saved on the driver card of the control unit 6. If a white line 9 is detected during production printing, the local area coverage is determined in a defined pixel window and the compensation halftone 15 saved for this value is inserted along the white line 9 in the pixel window. This process repeats itself, moving the pixel window along the white line in a sliding way. An example of a white line 9 that has been supplemented by respective matching compensation halftones 15 in its entirety is shown in FIG. 4. This process uses the respective compensation halftone that corresponds to the determined local area coverage until the entire white line 9 has been compensated for in the best possible way by means of the matching compensation halftone(s) 10. FIG. 5 illustrates the effect that the use of the respective suitable compensation halftones 10 in accordance with the invention has on the printed image 8. Although the two white lines 13 that have been compensated for are still barely discernible in the total print 8 because of a slightly deviant color value, the actual white line 9 has been closed and the remaining deviation in the entire print 8 is barely visible to the human eye.

The following is a summary list of reference numerals and the corresponding structure used in the above description of the invention:

1 feeder
2 printing substrate
3 delivery
4 ink jet printing unit
5 ink jet print head
6 computer
7 ink jet printing machine
8 entire print
9 white line
10 precalculated compensation screen
11 area coverage halftone area
12 white spot
13 white line that has been compensated in the print
14 print job/prepress data
15 compensation screen selected for compensation of a specific area coverage value

The invention claimed is:

1. A method for correcting for defective printing nozzles in an ink jet printing machine by a computer, wherein the defective printing nozzles are compensated for after a screening process by neighboring printing nozzles applying an increased amount of ink, which comprises the steps of:

precalculating different compensation halftones for different area coverages by means of the computer, the compensation halftones being precalculated in such a way that they include a white line caused by a defective printing nozzle at a center and are inserted into the white line caused by the defective printing nozzle in order to compensate for the defective printing nozzle;

printing the compensation halftones which are embedded in area coverage halftone areas;

evaluating printed compensation halftones by means of the computer;

selecting and saving, for every area coverage level, a compensation halftone that best matches a coloration of an original halftone in a respective area coverage halftone area by means of the computer;

detecting the defective printing nozzle during production printing by means of the computer;

determining a local area coverage along a detected defective printing nozzle by means of the computer; and using the compensation halftone that has been saved for a determined local area coverage to compensate for the defective printing nozzles by means of the computer.

2. The method according to claim 1, wherein for the local area coverage along the detected defective printing nozzle:

determining respective averages for specific regions along the detected defective printing nozzle; and using the compensation halftones that have been saved for the respective averages to compensate for the detected defective printing nozzle.

3. The method according to claim 2, wherein a size of the specific regions along the detected defective printing nozzle corresponds to a size of precalculated compensation halftones.

4. The method according to claim 1, wherein a precalculation of the different compensation halftones for the different area coverages for ink drop sizes of the compensation halftone is made in a random-based way.

5. The method according to claim 1, wherein a precalculation of the different compensation halftones for different area coverage levels for ink drop sizes of the compensation halftone factors in specific empirical values that are based on previous runs of the method.

6. The method according to claim 5, wherein a rule that a length and a width of a precalculated compensation halftone to a left and right of the detected defective printing nozzle is up to 150 μm is factored in when the compensation halftones are precalculated.

7. The method according to claim 5, wherein a rule that a total ink amount of a selected compensation halftone does not deviate by more than −5% to +30% from an original area coverage halftone that is to be replaced is factored in the precalculation of the compensation halftone.

8. The method according to claim 5, wherein a rule that characteristics of the compensation halftone corresponds to an original area coverage halftone that is to be replaced is factored in when the compensation halftones are precalculated.

9. The method according to claim 8, wherein the characteristics of the compensation halftone are selected from the group consisting of frequency, structure size, and preferred direction.

10. The method according to claim 1, which further comprises saving selected compensation halftones on a driver card for the computer of the ink jet printing machine, where the selected compensation halftones are accessed by the computer of the ink jet printing machine when the defective printing nozzle is detected and used to compensate for the defective printing nozzles.

* * * * *